United States Patent [19]

Nakai et al.

[11] Patent Number: 4,848,516

[45] Date of Patent: Jul. 18, 1989

[54] MOVABLE SCAFFOLD

[75] Inventors: Shigeo Nakai, Kurayoshi; Junkou Honda, Matsuyama, both of Japan

[73] Assignee: Yoneyama Kogyo Kabushiki Kaisha, Matsuyama-shi, Japan

[21] Appl. No.: 14,922

[22] Filed: Feb. 13, 1987

[30] Foreign Application Priority Data

| | | | |
|---|---|---|---|
| Feb. 17, 1986 | [JP] | Japan | 61-32442 |
| Jul. 23, 1986 | [JP] | Japan | 61-174399 |
| Jul. 24, 1986 | [JP] | Japan | 61-174780 |

[51] Int. Cl.[4] ..... E04G 3/14

[52] U.S. Cl. ..... 182/36; 182/63; 182/150

[58] Field of Search ..... 182/36–38, 182/63, 142, 150, 143, 144

[56] References Cited

U.S. PATENT DOCUMENTS

| | | | |
|---|---|---|---|
| 1,086,329 | 2/1914 | Liess | 182/38 X |
| 1,112,890 | 10/1914 | Royack | 182/37 X |
| 1,929,325 | 10/1933 | Masterson | 182/36 X |
| 2,067,344 | 1/1937 | Ringe | 182/36 X |
| 3,524,520 | 8/1970 | Tidwell | 182/36 |
| 3,550,723 | 12/1970 | Gentry | 182/36 |
| 3,930,441 | 6/1976 | Lacy | 182/37 X |
| 4,454,818 | 6/1984 | Eccleston et al. | 182/37 X |

FOREIGN PATENT DOCUMENTS

| | | | |
|---|---|---|---|
| 367168 | 10/1906 | France | 182/37 |
| 5857564 | 10/1979 | Japan . | |
| 9569 | of 1911 | United Kingdom | 182/36 |
| 12173 | of 1912 | United Kingdom | 182/36 |

*Primary Examiner*—Alvin C. Chin-Shue

*Attorney, Agent, or Firm*—Martin A. Farber

[57] ABSTRACT

A movable scaffold has a pair of hanger rails attached to a construction, first hanger units movably mounted on the hanger rails, beams operatively engaged with the first hanger units and laterally disposed with respect to the hanger rails, and a floor deck mounted on the beams. Second hanger units are provided for movably suspending the beams from the first hanger units.

5 Claims, 11 Drawing Sheets

FIG. 4
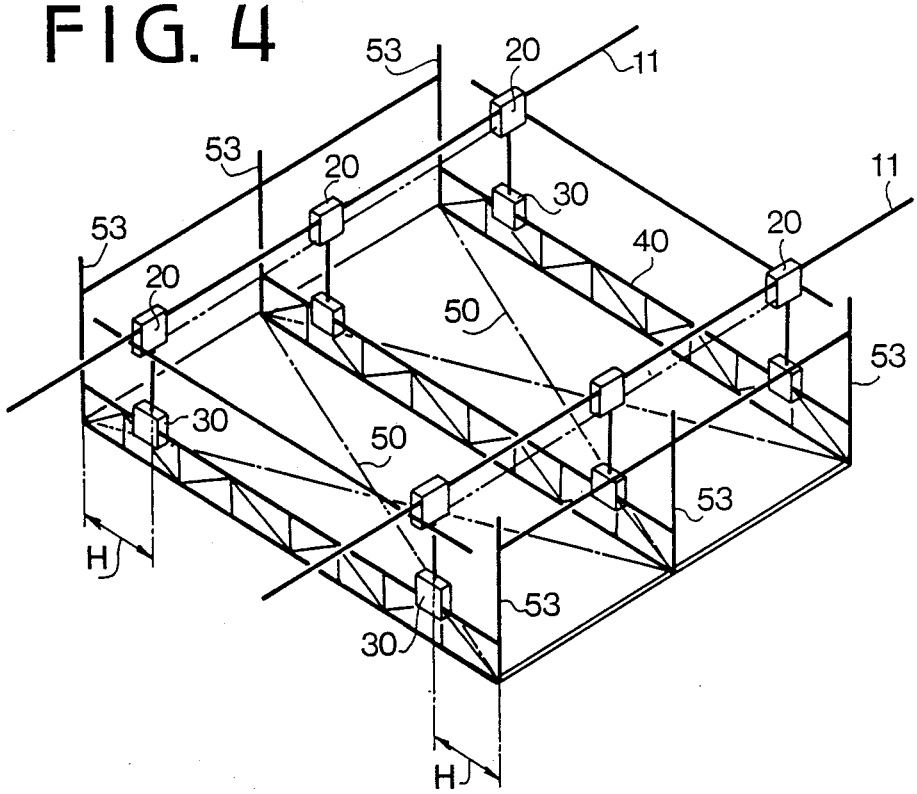
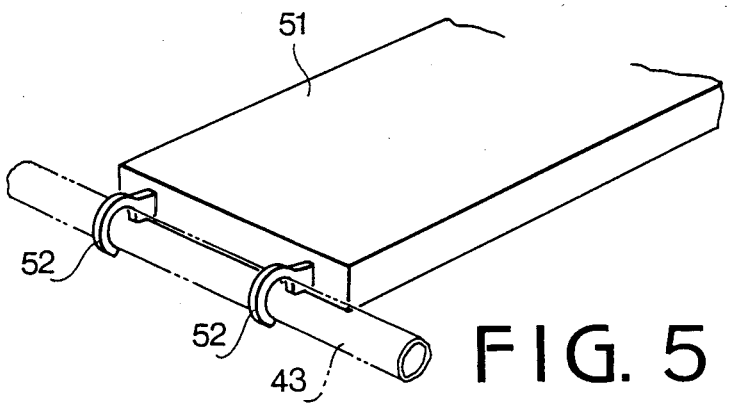
FIG. 5

MOVABLE SCAFFOLD

BACKGROUND OF THE INVENTION

The present invention relates to a movable scaffold for constructions, and more particularly to a movable scaffold used for maintenance such as repairs and painting of walls of a construction such as a bridge.

Usually, for maintenance work, a scaffold is assembled on the ground by steel pipes or a crane truck with a lifter is employed. Further, for maintenance work for big constructions such as a bridge, overhead road, and a gymnasium, the scaffold is mounted on beams of the construction so as to move along the beams, for continuously performing the maintenance work. Japanese Patent No. 1222171 discloses such a movable scaffold.

Since the maintenance work is performed, moving the scaffold along the beams, the width of the scaffold is set to a predetermined value corresponding to the distance between beams. However, at the exit or entrance zone of the highway, for example, the width of the road and hence the distance between the beams changes. Accordingly such a scaffold cannot be used with such a construction in which the distance between beams changes. Further, as shown in FIG. 7, when a beam 3a is obliquely mounted on a pier 5 in a plan view, the scaffold 8 cannot be moved to an end porion of the beam, so that the maintenance work cannot be performed at a section S indicated by a checkered pattern.

SUMMARY OF THE INVENTION

The object of the present invention is to provide a movable scaffold for performance of maintenance work for a construction in which beams are irregularly arranged.

According to the present invention, there is provided a movable scaffold having a pair of hanger rails attached to a construction, first hanger units movably mounted on the hanger rails, beams operatively engaged with the first hanger units and laterally disposed with respect to the hanger rails, and a floor deck mounted on the beams. The scaffold comprises each of the beams being provided with a guide rail, second hanger units suspending the beams from the first hanger units, and each of the beams being movably supported on each second hanger unit by engagement of wheels mounted in the second hanger unit with the guide rail.

In an aspect of the present invention, the second hanger unit is suspended from the first hanger unit so as to be rotatable about a vertical axis, the second hanger unit has a pinion and the guide rail of the beam has a rack engaged with the pinion.

BRIEF DESCRIPTION OF THE DRAWINGS

FIG. 4 is a schematic perspective view of the movable scaffold;

FIG. 5 is a perspective view showing a part of a floor board provided on the truss beam unit;

DETAILED DESCRIPTION OF THE PREFERRED EMBODIMENTS

Figure 1A:
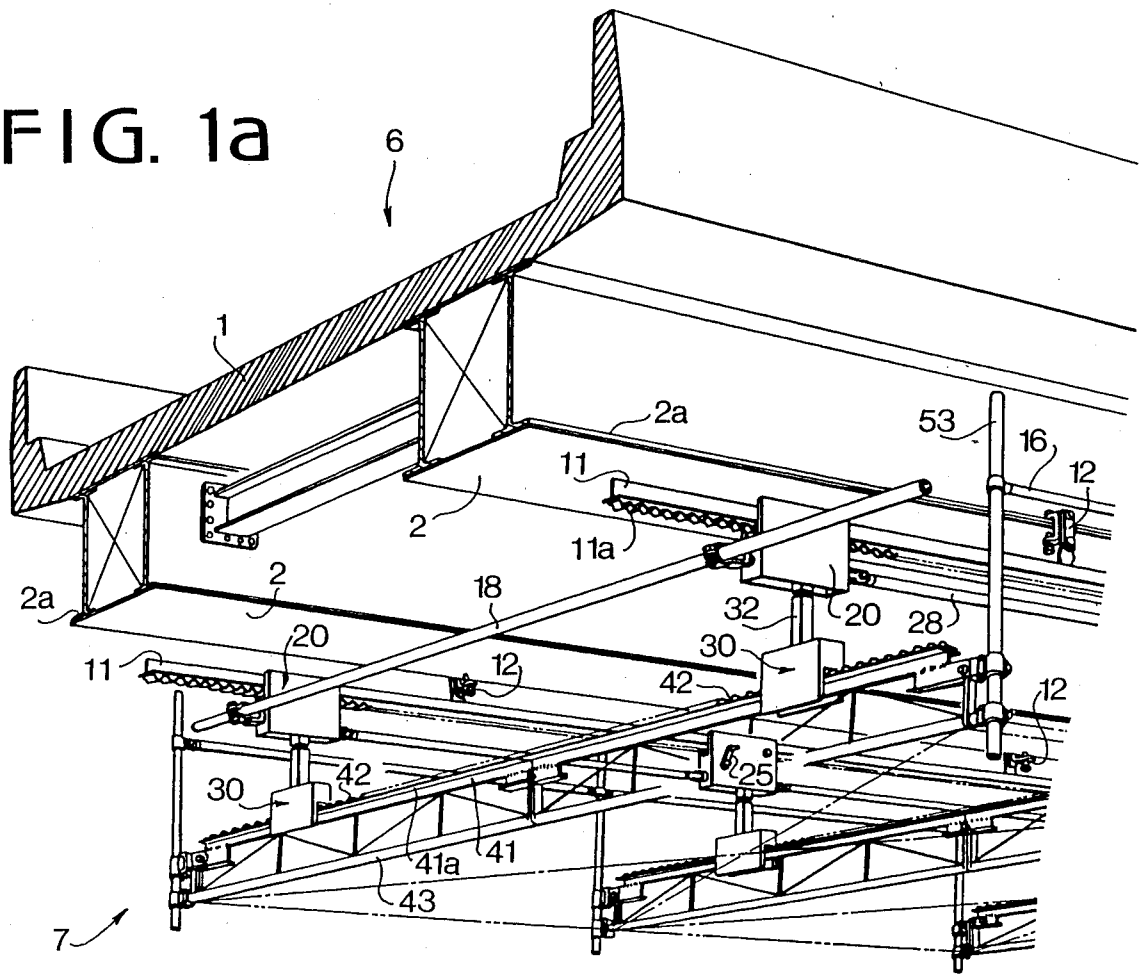
FIGS. 1a and 1b are perspective views showing a movable scaffold according to the present invention.
Figure 1B:
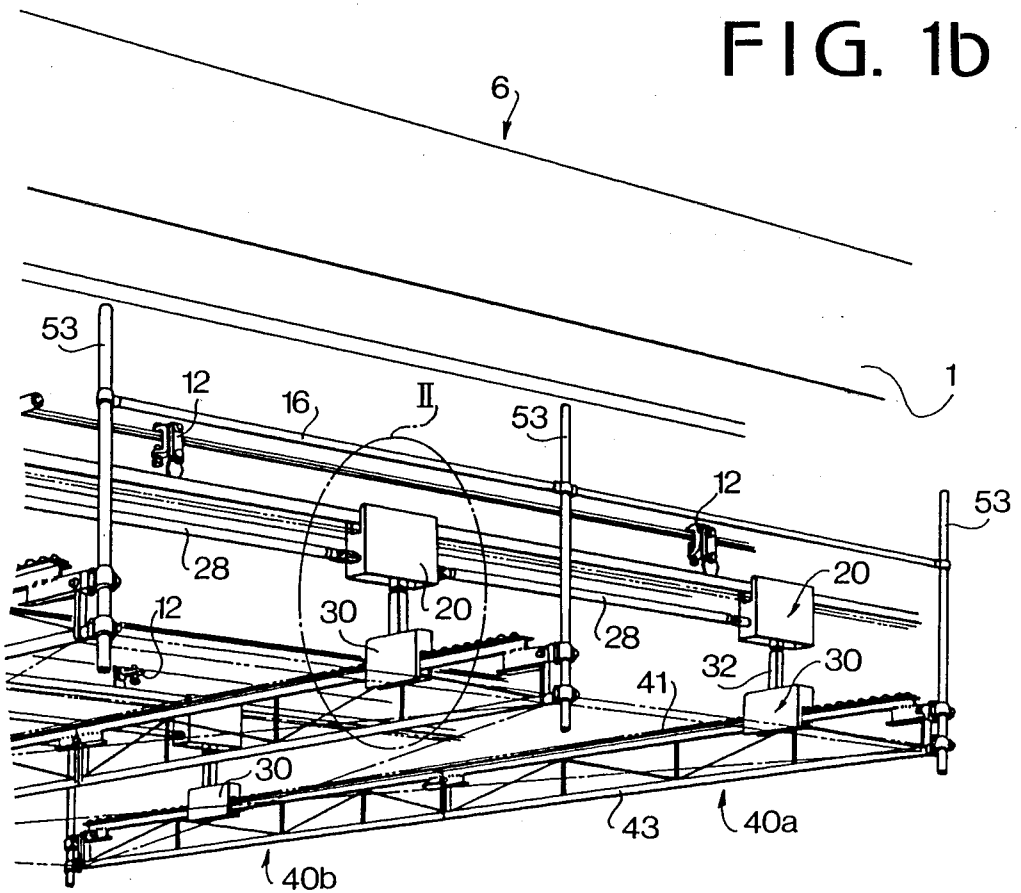
Figure 2:
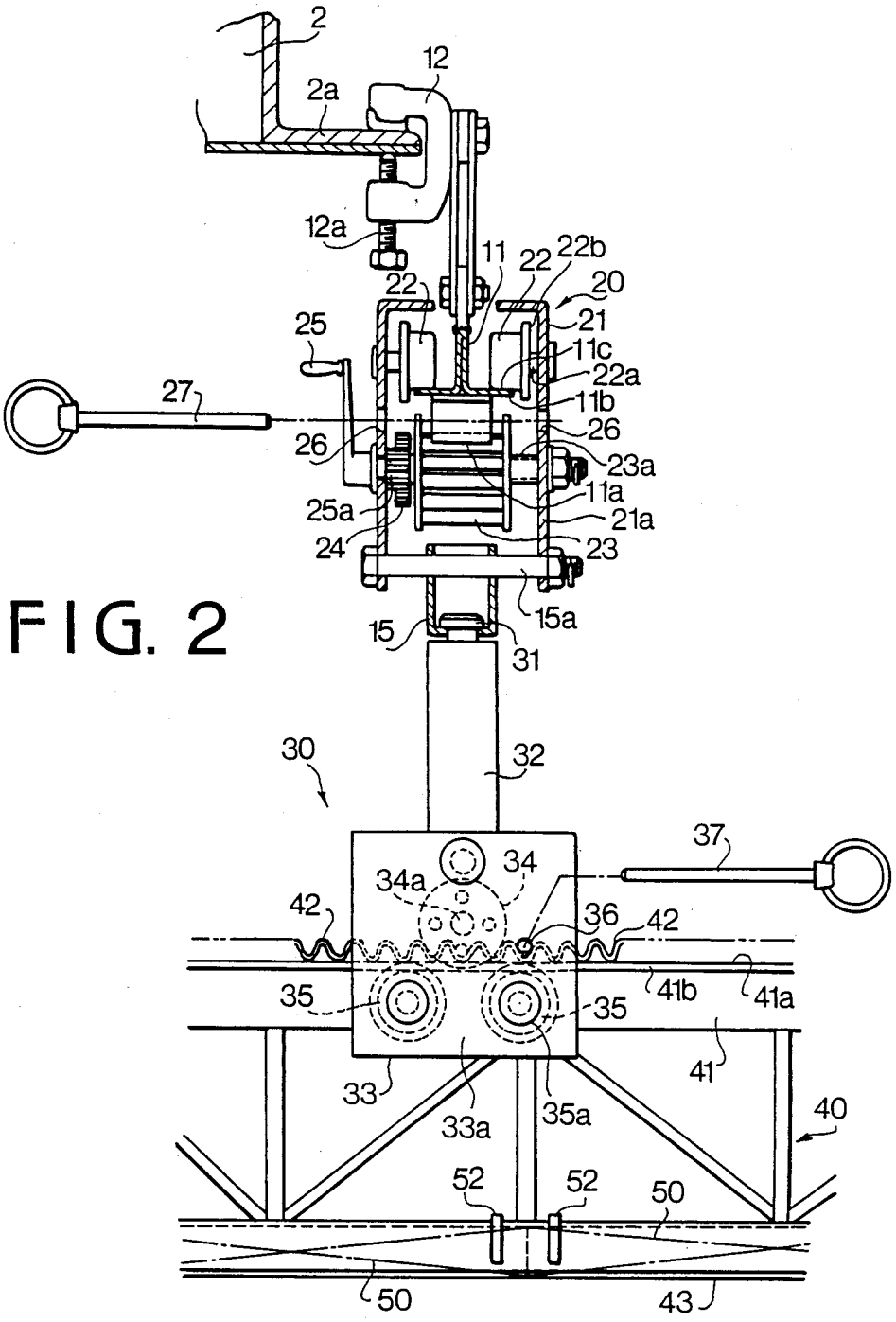
FIG. 2 is a sectional view of a hanger unit indicated by an ellipse II of FIG. 1.

Referring to FIGS. 1a, 1b and 2, a movable scaffold 7 according to the present invention is constructed on a soffit of a bridge 6. The bridge 6 comprises a flooring 1 as a road supported by a pair of box beams 2 having flanges 2a. The movable scaffold 7 has a guide unit and a movable unit.

The guide unit comprises a pair of hanger (guide) rails 11, each having a reversed T-shaped section, and a plurality of C-clamps 12 secured to the hanger rails 11. The guide rail 11 has a rack 11a longitudinally provided on a horizontal flat surface 11b. The hanger rail 11 is hung from the flange 2a of box beam 2 by C-clamps 12 with screws 12a.

The movable unit has a plurality of first hanger units 20 mounted on the guide rails 11, second hanger units 30 provided corresponding to the first hanger units 20, and trussed beams 40 mounted on the second hanger units 30.

Referring to FIG. 2, the first hanger unit 20 is provided with means to be engaged with the guide rail 11 in a box-like casing 21. A pair of opposite wheels 22 are rotatably secured to side plates 21a of the casing 21 through the respective shafts 22a. Below the wheels 22, a pinion 23 is rotatably supported on a shaft 23a secured to side plate 21a. In order to mount the first hanger unit 20 on the guide rail 11, the guide rail 11 hung from the beam 2 is inserted into the casing 21 through an opening formed on an upper portion thereof. The wheels 22 are rotatably mounted on edges 11c of the guide rail 11, respectively. The pinion 23 is engaged with a rack 11a formed on the underside of the rail 11. Each of the wheels 22 has a flange 22b to prenent the wheel 22 from derailing from the guide rail 11.

At least one of first hanger units 20 has a handle 25 for effecting movement of the scaffold 7. The handle 25 is engaged with a gear 24 securely mounted on the shaft 23a through a gear 25a secured to a shaft of the handle. Thus, when the handle 25 is rotated, the shaft 23a is rotated through the gear 24, and the pinion 23 is rolled on the rack 11a in the longitudinal direction. A lock pin 27 is provided to lock the engagement of the rack 11a and pinion 23. The lock pin 27 is inserted into holes 26 formed on opposite side plates 21a corresponding to the rack 11a and engaged with opposite teeth of the rack 11a, when the unit 20 is mounted on the guide rail 11 at a desired position.

The first hanger units 20 are disposed in a row on the respective guide rails 11 at an equidistant disposition along the guide rail, and laterally opposite to each other, having the respective second hanger units 30. A rod 28 is horizontally connected between first hanger units 20.

At a lower portion of the casing 21, a suspension member 15 for suspending the second hanger unit 30 is supported on a shaft 15*a* secured to side plates 21*a*. The second hanger unit 30 has a box-like casing 33 for supporting the trussed beam 40. A suspension member 32 is provided on an upper portion of the casing 33 and connected to the suspension member 15 of the first hanger unit 20 through a thrust bearing 31 so as to be rotated about a vertical axis of the bearing. The casing 33 is suspended from the first hanger unit 20 at a right angle to the unit.

In the casing 33, a pinion 34 is rotatably supported on a shaft 34*a* secured to opposite side plates 33*a*, and a pair of opposite wheels 35 are rotatably supported on respective shafts 35*a* secured to the side plates 33*a* below the pinion 34.

Figure 3:
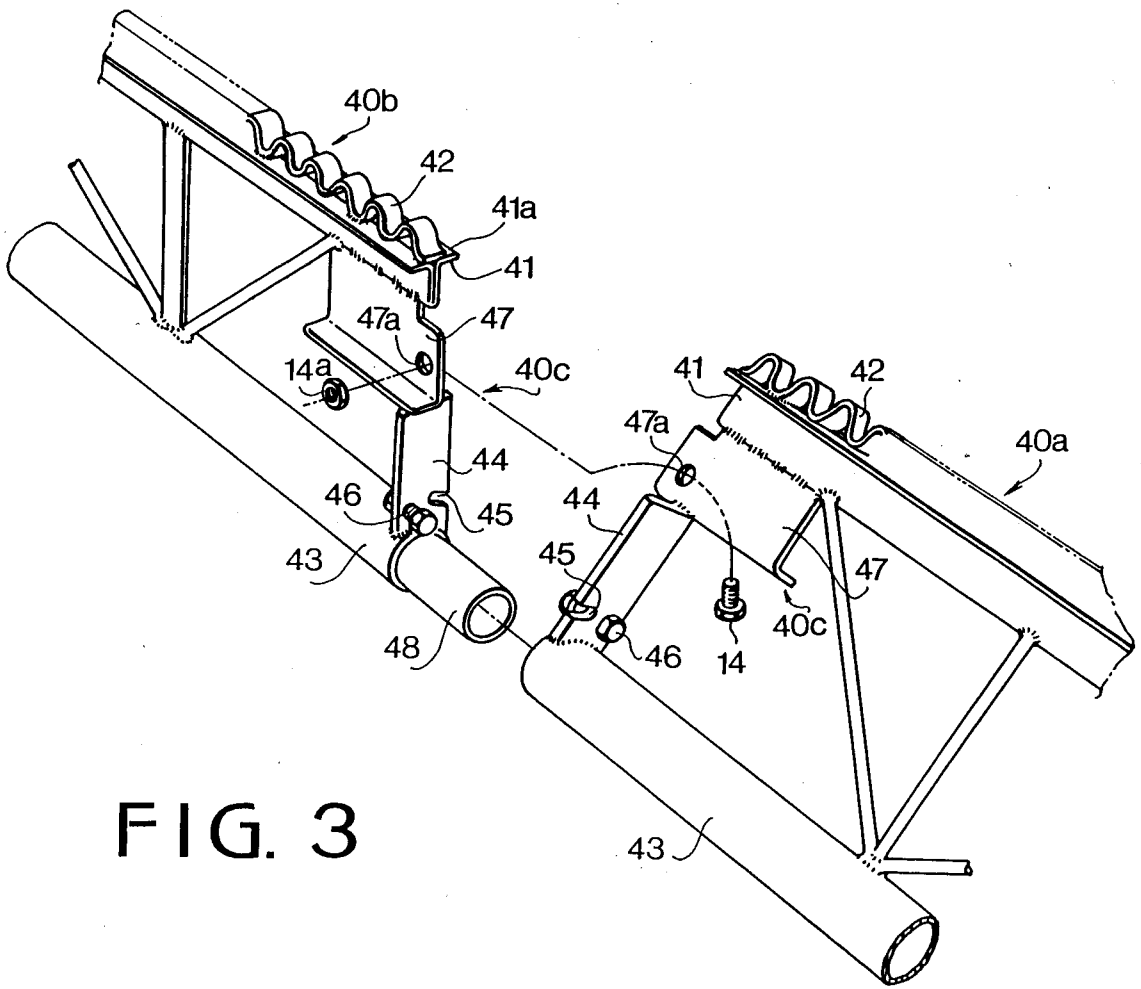
FIG. 3 is a perspective view partly showing a truss beam unit provided on a hanger unit.

As shown in FIGS. 2 and 3, the trussed beam 40 consists of a pair of unit beams 40*a* and 40*b* connected each other by connecting means 40C. Each trussed beam comprises a T-shaped guide rail 41 having a corrugated rack 42 provided on a horizontal surface 41*a*, and a pipe 43 in parallel with the guide rail 41. The guide rail 41 is inserted into the casing 33 of the second hanger unit 30 from an opening formed on a lower portion thereof. The guide rail 41 is inserted into the space between the pinion 34 and wheels 35 in such a manner that the corrugated rack 42 is engaged with the pinion 34 and edges 41*b* of the guide rail 41 are supported on wheels 35.

The side plates 33*a* of the casing 33 have opposite holes 36 formed corresponding to the space between teeth of the rack 42. A lock pin 37 is inserted into holes 36, engaging with the rack 42. Thus, the rotation of the pinion 34 along the rack 42 is prevented by the pin 37.

For the connection of one trussed beam 40*a* to the other beam 40*b*, connecting means 40*c* are symmetrically provided in the space between the guide rail 41 and pipe 43 at end portions of respective beams. As shown in FIG. 3, each of the symmetrical connecting means 40*c* comprises an L-shaped connecting plate 47 secured to the guide rail 41, and a connecting plate 44 secured to the connecting plate 47 and pipe 43. Beam 40*b* has a joint pipe 48 projected from the pipe 43. Each of the L-shaped connecting plates 47 has a hole 47*a* formed to be corresponding to each other. Each of the connecting plates 44 has a notch 45 and a bolt 46 secured thereto adjacent to the notch 45. The bolt 46 is adapted to engage with the notch 45 of other plate 44. One L-shaped plate 47 is put on another plate 47, corresponding holes 47*a* to each other, one connecting plate 44 is put on the other, engaging the shank of the bolt 46 with the notch 45 respectively, the joint pipe 48 is inserted into the corresponding pipe 43, and the plates 47 are secured by a bolt 14 and nut 14*a*.

As shown in FIG. 5, a plurality of floorboards 51 are provided for forming a floor deck 50 of the scaffold 7. Each of the floorboards 51 has a pair of hooks 52 provided on opposite end portions thereof. The hooks 52 are engaged with the pipe 43 of the trussed beam 40 to fill the space defined by opposite trussed beams 40, so that the floor deck 50 is formed as shown in FIG. 4.

The trussed beam 40 is constructed to have a length longer than the distance of the opposite first hanger units 20 in the lateral direction, when the units are attached to the beams 2. Namely the trussed beam 40 outwardly projects from the second hanger units 30, as shown in FIG. 4, having projected portions H of the floor deck 50.

A pole 53 is vertically secured to each end of the trussed beam 40. A pipe 16 is connected between poles 53. A rod 18 is transversely connected between opposite first hanger units 20 at both ends of the row of the units.

Describing the operation of the scaffold 7, hanger rails 11 are hung to flanges 2*a* of beams 2. The distance of the guide rails 11 in the lateral direction is dependent on the dispositions of the beams 2. The first hanger units 20, second hanger units 30, trussed beams 40, and floor deck 50 are assembled in order. By rotating the handle 25, the first hanger units 20 connected in the row by rods 28 are longitudinally moved along the guide rails 11. The floor deck 50 formed on the trussed beams 40 moves in cooperation with the first hanger units 20 through the second hanger units 30. If the box beams 2 curve in the plan view, or if the distance between the beams 2 becomes larger or smaller than the distance between the first hanger units, the distance of opposite first hanger units 20 is changed in dependency on the variation. At that time, the second hanger units 30 are moved on the guide rail 41 of the trussed beam 40 to the right or left as the pinion 34 rotates on the rack 42 and the wheels 35 rotate on the edges 41*b* in accordance with the variation of the distance between units 20. Thus, the scaffold can be moved along the beams 2, absorbing the variation of the distance between the beams.

Figure 6:
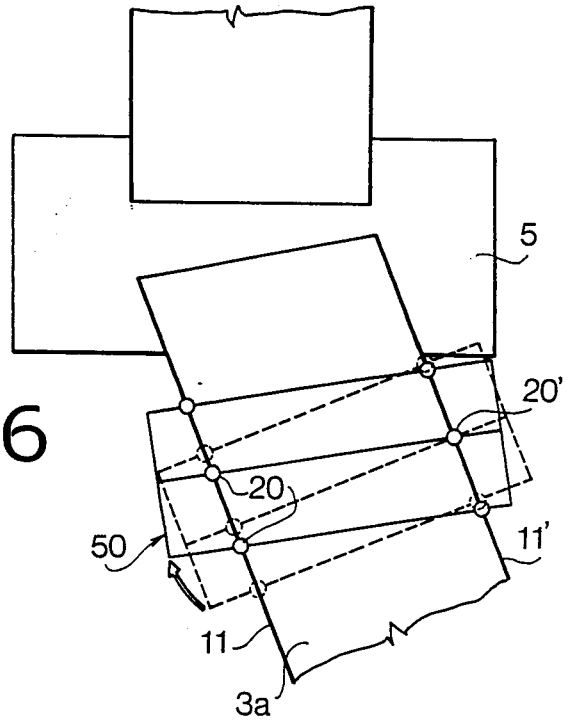
FIG. 6 is a schematic plan view showing an example of an operating state of the system.
Figure 7:
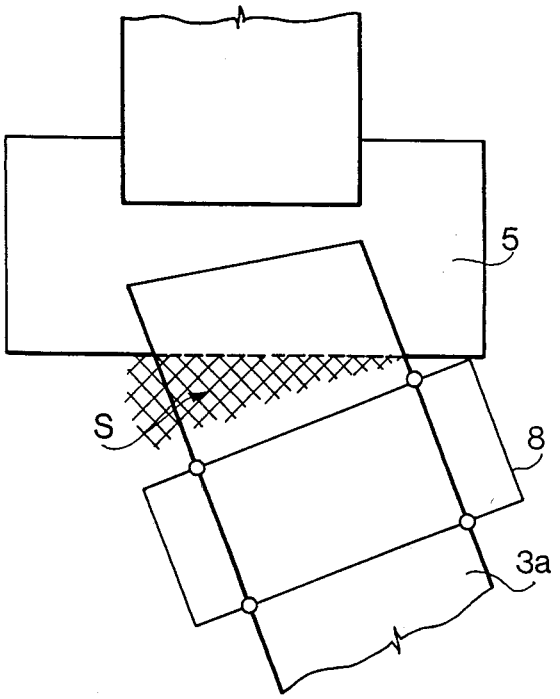
FIG. 7 is a schematic plan view showing an operating state of a conventional movable scaffold.

As shown in FIG. 6, in the case the beam 3*a* is obliquely built on the pier 5 in plan view, when the floor deck 50 comes to the pier 5, the first hanger unit 20' of the inner side is locked by the pin 27 which is inserted into holes 26 to engage with the rack 11*a* of the guide rail 11'. On the other hand, the first hanger unit 20 of the outer side can be moved along the guide rail 11 by the operation of handle 25, rotating the trussed beam 40 about the bearing 31. Thus, the floor deck 50 is moved to a position close to the pier 5 indicated by an arrow.

Figure 8:
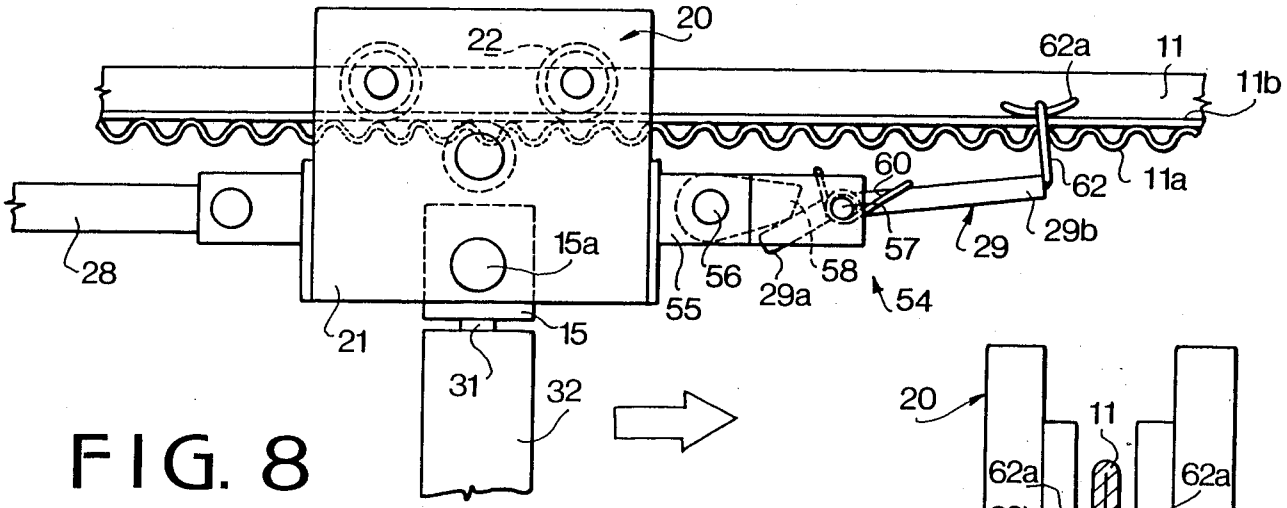
FIG. 8 is a side view of a derailment preventing device mounted on the first hanger unit.
Figure 9:
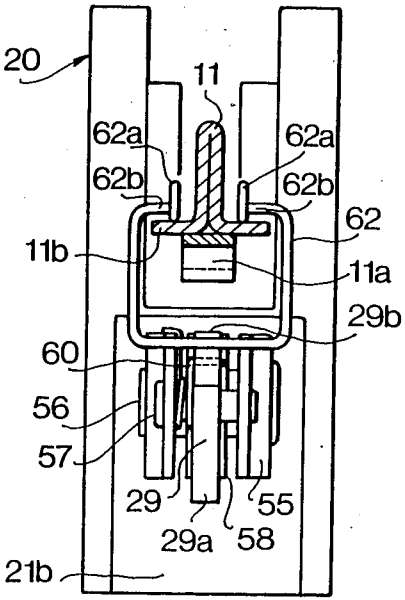
FIG. 9 is a front view of the device.
Figure 10:
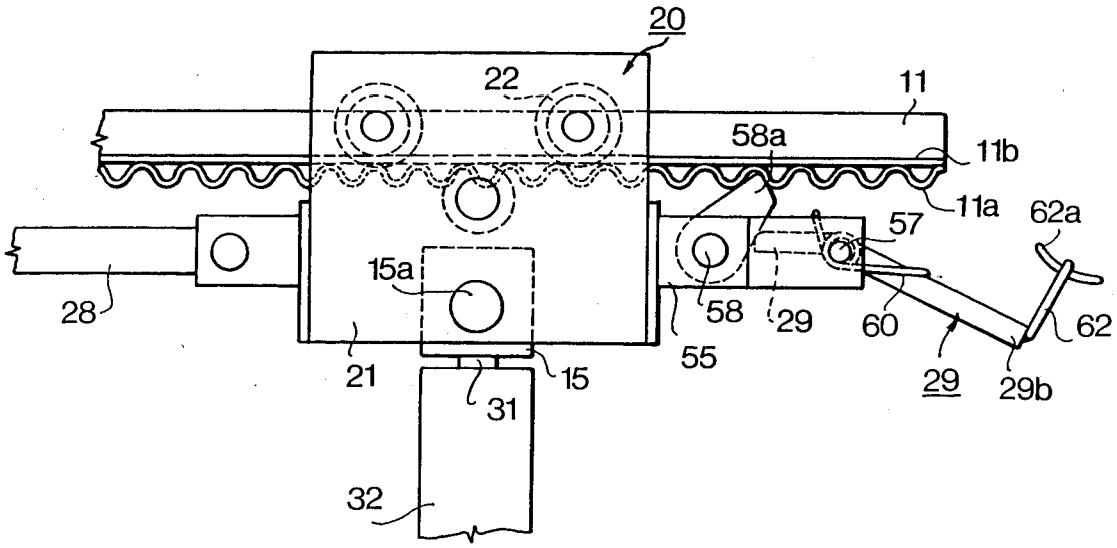
FIG. 10 is a side view of the device in operating state.

Referring to FIGS. 8 to 10, in the row of first hanger units 20, a unit which takes the head of the row has a device for preventing the derailment of the first hanger unit 20 from the guide rail 11 in the longitudinal direction.

A derailment preventing device 54 comprises a pair of cantilever arms 55 secured to a front wall 21*b* of the casing 21, a stopper 58 pivoted on a shaft 56 secured to the cantilever arms 55, and a lever 29 pivotally mounted on a shaft 57 secured to an end portion of arms 55 and urged in the clockwise direction (in FIG. 8) by a spring 60. The lever 29 is, at an end 29*b* thereof, provided with a C-shaped slider 62 having a pair of sliding shoes 62*a* secured to both ends 62*b* thereof. Another end 29*a* of the lever 29 is engaged with the underside of the stopper 58 against the elastic force of the spring 60. The sliding shoes 62*a* are slidably mounted on the flat surfaces 11*b* of the guide rail 11.

As shown in FIGS. 8 and 10, as the scaffold 7 is moved in the direction indicated by an arrow and the leading first hanger unit 20 reaches near an end of the guide rail 11, the sliding shoes 62*a* disengage from the guide rail 11. The lever 29 is pivotally rotated about the shaft 57 by the spring 60. The end 29*a* of the lever is upwardly rorated to lift up the stopper 58. Accordingly, an end 58*a* of the stopper 58 is engaged with the rack 11*a*, so that the first hanger unit 20 stops. Thus, the derailment of the first hanger unit is be prevented.

Figure 11:
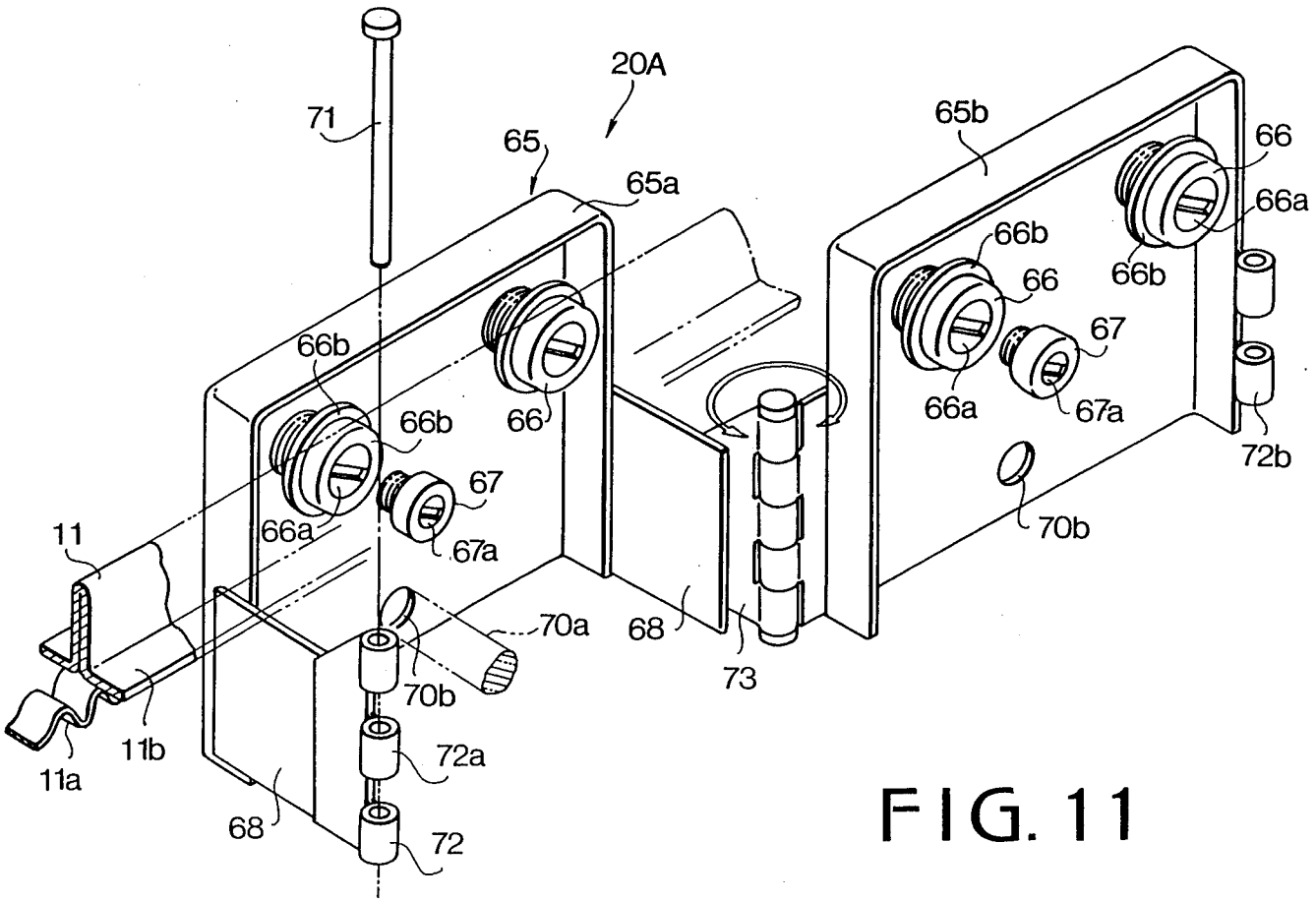
FIG. 11 is a developed perspective view of a first hanger unit of another embodiment of the present invention.
Figure 12:
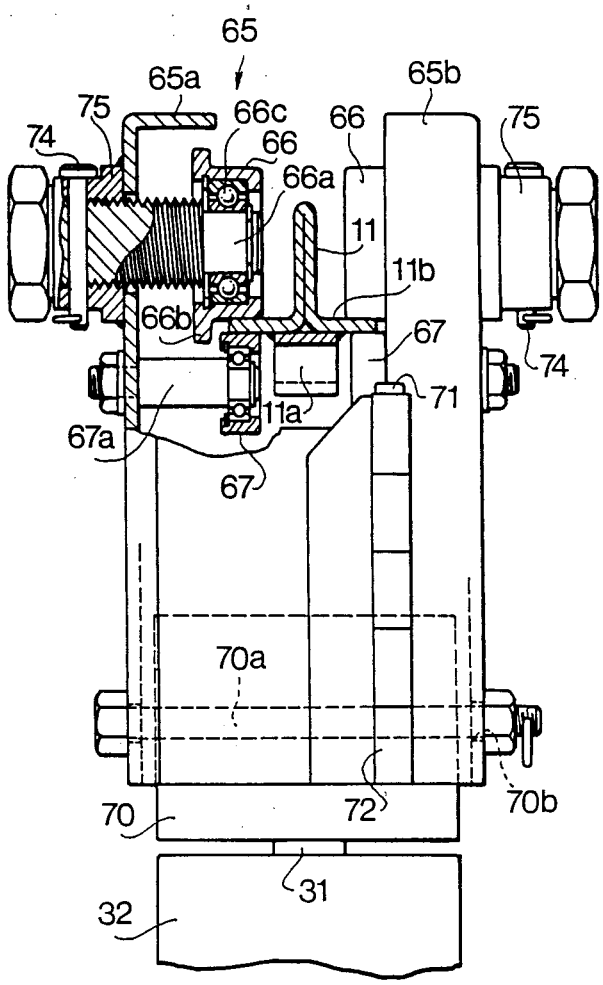
FIG. 12 is a sectional front view of the first hanger unit of FIG. 11.
Figure 13:
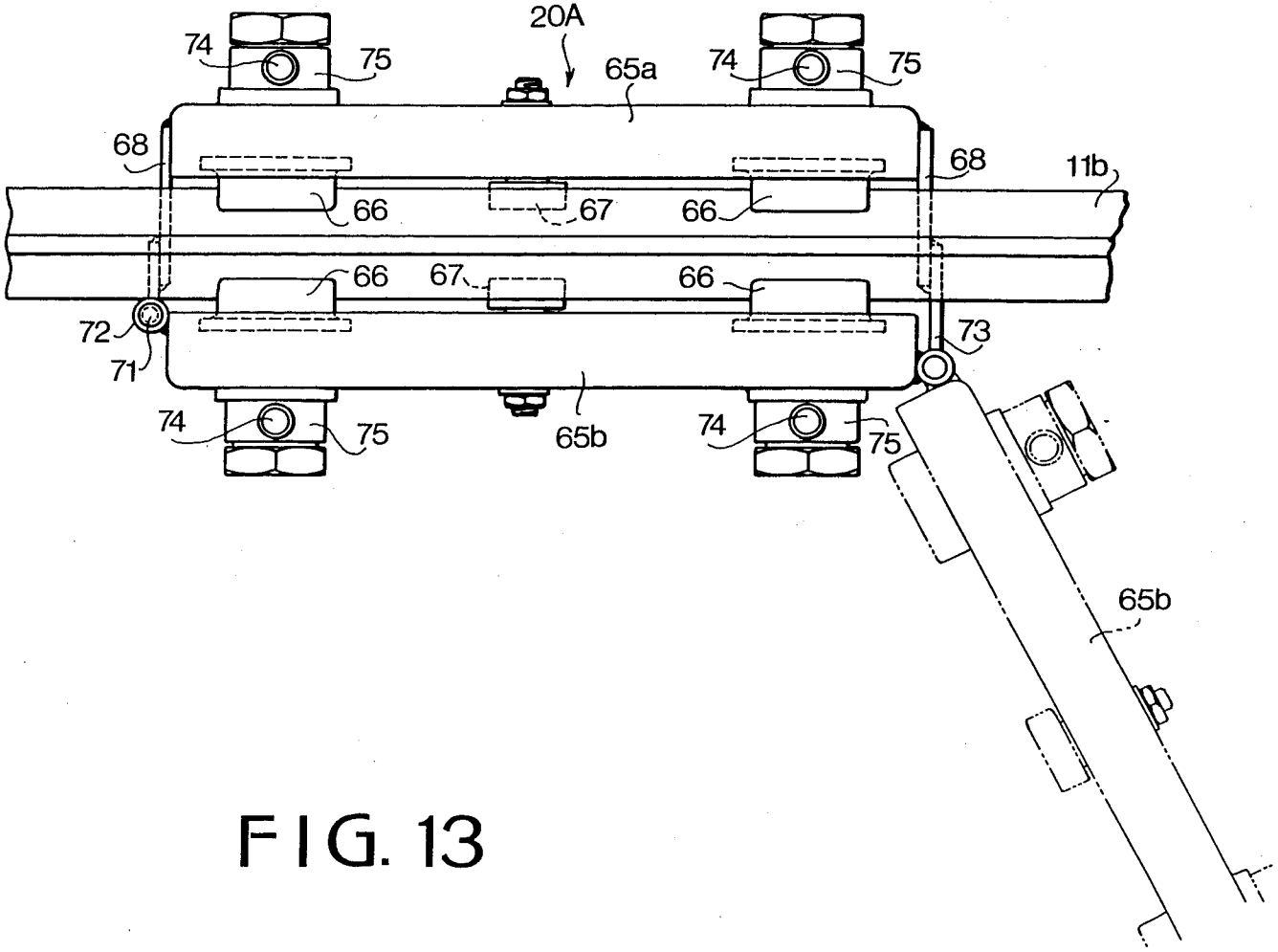
FIG. 13 is a plan view of the first hanger unit mounted on the guide rail.

Referring to FIGS. 11 to 13, a first hanger unit 20A of another embodiment of the present invention comprises a casing 65 which is separable into a pair of frames 65*a* and 65*b*. The frame 65*a* is connected to the frame 65*b* by hinges 72 and 73 through flaps 68. One of the hinge 72 is adapted to separate into a cylindrical portion 72*a* secured to one of the flaps 68 and a cylindrical portion 72*b* secured to the frame 65*b* by removing a lock pin 71. Thus, the casing 65 is opened as shown in FIG. 11.

In each of the frames 65*a* and 65*b*, a pair of wheels 66 each having a flange 66*b* are rotatably supported through threaded shafts 66*a* and a wheel 67 is rotatably supported by a shaft 67*a* below the wheels 66. As shown in FIG. 12, the shaft 66*a* which supports the wheel 66 through bearings 66*c* is engaged with a nut 75 secured to the outside the frame 65*a* and locked by a lock pin 74 through the nut 75 so s to prevent the shaft 66*a* from rotating. A suspension member 70 is supported on a shaft 70*a* which is engaged with holes 70*b* of frames 65*a* and 65*b*.

The first hanger unit 20A is attached to the guide rail 11 as follows. The casing 65 is opened, the wheels 66 and wheel 67 of the frame 65*a* are engaged with the flat surface 11*b* of the guide rail 11, and then, the frame 65*b* is closed, the wheels 66 and wheel 67 of the frame 65*b* are engaged with the other flat surface 11*b*. The cylindrical portion 72*b* is engaged with the cylindrical portion 72*a*. The pin 71 is inserted into the hinge 72 to lock the frames 65*a* and 65*b*. In order to accurately engage the wheels 66 with the guide rail 11, the wheel 66 is axially moved to a proper position by adjusting the threaded shaft 66*a*.

While the presently preferred embodiments of the present invention have been shown and described, it is to be understood that this disclosure is for the purpose of illustration and that various changes and modifications may be made without departing from the spirit and scope of the invention as set forth in the appended claims.

What is claimed is:

1. A movable scaffold comprising a pair of hanger rails attached to an underside of construction, first hanger units movably mounted on the hanger rails, beams being disposed below the first hanger units, a floor deck mounted on the beams and located below the construction, each of the beams being provided with a guide rail, second hanger units suspending the beams from the first hanger units, said second hanger units having wheels mounted thereon, each of the beams being movably supported on each second hanger unit by engagement of said wheels with the guide rail, said second hanger units being suspended from the first hanger units respectively so as to be rotatable about a vertical axis, whereby the beams and the floor deck thereon may be obliquely positioned with respect to the hanger rails, said beams comprising a pair of unit beams separatable in the middle, and connecting means for connecting each of said unit beams to each other, each of said pair of unit beams is a trussed beam, said trussed beam comprises a pipe disposed in parallel to said guide rail, said pipes of adjacent of said trussed beams are telescopically and pivotally connected to each other and comprise said connecting means, and said connecting means further comprises two connecting plates connecting said guide rail and said pipe, and means for fastening said two connecting plates to each other.

2. The movable scaffold according to claim 1 wherein the second hanger unit has a pinion and the guide rail of each beam has a rack engaged with the pinion.

3. The movable scaffold according to claim 1 wherein the first hanger unit has a derailment preventing device.

4. The movable scaffold according to claim 1 wherein each first hanger unit has a casing which is provided to be opened horizontally so as to be attached to the hanger rail.

5. The movable scaffold according to claim 3, wherein said derailment preventing device comprises a lever slidably engaging said hanger rail and pivoted on said first hanger unit, a stopper pivoted on said first hanger unit and engaging a free end of said lever, said free end of said lever pivoting said stopper into a position so as to lock into said hanger rail when said lever is pivoted out of said engagement with said hanger rail so as to lock the first hanger unit to said hanger rail when said lever is out of said engagement with said hanger rail.

* * * * *